US008201827B2

(12) United States Patent
Weingardt

(10) Patent No.: US 8,201,827 B2
(45) Date of Patent: Jun. 19, 2012

(54) VIDEO BINGO GAME AND METHOD

(75) Inventor: Gary Weingardt, Las Vegas, NV (US)

(73) Assignee: Gamin Weingardt, Las Vegas, NV (US)

( * ) Notice: Subject to any disclaimer, the term of this patent is extended or adjusted under 35 U.S.C. 154(b) by 1602 days.

(21) Appl. No.: 09/949,311

(22) Filed: Sep. 7, 2001

(65) Prior Publication Data

US 2002/0113369 A1 Aug. 22, 2002

Related U.S. Application Data

(63) Continuation-in-part of application No. 09/745,706, filed on Dec. 26, 2000, now Pat. No. 6,565,091.

(51) Int. Cl.
*A63F 3/06* (2006.01)

(52) U.S. Cl. ..... 273/269; 463/19

(58) Field of Classification Search ..... 273/274, 273/299, 269; 463/13, 16, 17, 18, 19
See application file for complete search history.

(56) References Cited

U.S. PATENT DOCUMENTS 4,560,171 A * 12/1985 Anthony ..... 273/269
4,856,787 A * 8/1989 Itkis
5,100,139 A * 3/1992 Di Bella ..... 273/292
5,393,057 A * 2/1995 Marnell, II
5,647,798 A * 7/1997 Falciglia
5,727,786 A * 3/1998 Weingardt ..... 273/269
5,833,537 A * 11/1998 Barrie
5,868,618 A * 2/1999 Netley et al.
5,971,849 A * 10/1999 Falciglia
6,079,711 A * 6/2000 Wei et al. ..... 273/269
6,110,040 A * 8/2000 Sanduski et al.
6,149,156 A * 11/2000 Feola ..... 273/292
6,149,157 A * 11/2000 Suan

* cited by examiner

*Primary Examiner* — William Pierce
(74) *Attorney, Agent, or Firm* — Weiss & Moy, P.C.; Jeffrey D. Moy

(57) ABSTRACT

A bingo game and method in which bingo rules are used to simulate video poker and slot machine games. Players using linked terminals are assigned flashboards having multiple squares thereon, which squares have indicia thereon. If video poker is to be simulated, the indicia will be suit and value indicia of the type associated with playing cards. If slot machine play is to be simulated, the indicia will be of the like associated with slot machines, such as cherries, bars and bells. The calling of numbered bingo balls leads to the display to the player of corresponding indicia from numbered squares on the flashboard. A multiple overlapping ball draw may be utilized to accommodate slower and faster players, to allow overlapping games so that a slower player can have more time to play while a faster player can finish one game and commence another before the first game has closed. Where no player achieves a winning combination, an award can be provided based on a pre-determined value of indicia received by the player, including a near miss or a lowest hand. In one embodiment, the near-miss award may be paid from a progressive jackpot, to increase player excitement and to incentivize players to try for a near-miss hand.

7 Claims, 5 Drawing Sheets

VIDEO BINGO GAME AND METHOD

CROSS-REFERENCE TO RELATED APPLICATION

This is a continuation-in-part of U.S. patent application Ser. No. 09/745,706, filed Dec. 26, 2000 now U.S. Pat. No. 6,565,091 in the name of the Applicant, to which priority is claimed.

FIELD OF THE INVENTION

This invention relates generally to bingo games, and more particularly to a video bingo game and method that utilizes bingo rules to present video games having the look and feel of video poker and slot games, and that preferably utilize multiple ball draws to provide a pace of play beneficial to fast and slow players alike.

BACKGROUND OF THE INVENTION

The rules of play for conventional bingo are well-known. Players receive individual game cards, generally featuring a matrix of five rows and five columns. The columns are lettered B I N G O from left to right across the top of the matrix and each bingo card has five numbers in each row, except for the center I column which has a "free space" at the intersection of the third row and the third column.

Bingo balls individually numbered 175 are mixed together and balls are selected one at a time. As each ball is selected, the number is announced to the players, who cover any corresponding number on their bingo card. When a player achieves a predetermined arrangement of covered spots on his bingo card, that player yells out "Bingo!" or hits the bingo button and he wins the game.

Bingo is increasingly being played in electronic form. Players operate linked machines that display one or more bingo cards. Numbers are called by live ball draw, or a bonanza game and the called numbers are daubed on the player cards on each linked machine. Each game is played until a winning card on at least one linked machine is produced, after which another game may be started.

But there are a number of drawbacks associated with prior art electronic bingo games. Many players prefer the fast action of video poker and slot machines to relatively slower traditional bingo games. Such players will tend to avoid electronic bingo games entirely, in favor of competing games.

Moreover, even for those who prefer to play bingo, prior art video bingo games are not entirely satisfactory. One drawback is timing. Depending on the player, the game may be too fast or too slow. Thus, each game will have a single ball draw and a time limit, perhaps in the range of about 20 seconds. A fast player might be able in significantly less than the allotted time to complete his or her selections and be ready to play the next game—only to be forced to wait until the game has closed and the next one begun with another ball draw. After a series of games, a player who is required to spend a significant time waiting may well opt to leave the machine and choose a faster-paced game.

On the other hand, a slower player might find that he or she cannot make the required selections in time, with the result that the game closes before they have finished. Players who cannot finish the game in the allotted time can also be expected to lose interest.

A need therefore existed for an electronic bingo game having the look and feel of a non-bingo game, including for example video poker or video slots (sometimes also referred to as "fruit machines"). A need further existed for an electronic bingo game that accommodates the play habits of both fast and slow players. The present invention satisfies these needs and provides other, related, advantages.

SUMMARY OF THE INVENTION

It is an object of the present invention to provide an electronic bingo game and method having the look and feel of a non-bingo game, including for example video poker or video slot machines.

It is a further object of the present invention to provide an electronic bingo game and method that accommodates the play habits of both fast and slow players.

It is a still further object of the present invention to provide a bingo game and method that provides a "near-miss" or "case" bingo reward or the like to provide a payout, in addition to the normal slot payouts as reflected on a pay table, which is preferably paid in the event that a game does not produce a hand falling within the pay table, and further that provides a progressive jackpot for case bingos.

Other objects, features and advantages of the present invention will become apparent from a consideration of the following detailed description.

BRIEF DESCRIPTION OF THE PREFERRED EMBODIMENTS

In accordance with one embodiment of the present invention, a bingo game is disclosed. The game comprises, in combination: a plurality of player terminals; wherein each said player terminal has a display screen thereon; a plurality of flashboards each having a plurality of numbered spaces; wherein said plurality of numbered spaces has indicia associated therewith; wherein said indicia comprises each of suit and value indicia; and a plurality of bingo balls each having individual numbers corresponding to said numbered spaces on said flashboard.

In accordance with another embodiment of the present invention, a bingo game is disclosed. The game comprises, in combination: a plurality of player terminals; wherein each said player terminal has a display screen thereon; a plurality of flashboards each having a plurality of numbered spaces; wherein said plurality of numbered spaces has indicia associated therewith; wherein said indicia comprises indicia of the type commonly displayed on slot-type machines; and a plurality of bingo balls each having individual numbers corresponding to said numbered spaces on said flashboard.

In accordance with still another embodiment of the present invention, a method of playing a game of bingo is disclosed. The method comprises the steps of: providing at least one player with a flashboard having a plurality of numbered spaces; wherein said plurality of numbered spaces has indicia associated therewith; providing a plurality of bingo balls each having individual numbers corresponding to numbered spaces on said flashboard; initiating the bingo game; randomly selecting bingo balls; displaying to said at least one player said indicia associated with each said numbered space corresponding to each said selected bingo ball; and if said at least one player achieves a predetermined winning combination of said displayed indicia, providing an award to said at least one player.

In accordance with yet another embodiment of the present invention, a method of playing a game of bingo is disclosed. The method comprises the steps of: providing each player with a flashboard having a plurality of numbered spaces; wherein said plurality of numbered spaces has indicia associated therewith; providing a plurality of bingo balls each having individual numbers corresponding to numbered spaces on said flashboard; initiating the bingo game; randomly selecting consecutive bingo balls; displaying to each said player said indicia associated with each said numbered space corresponding to each said selected bingo ball; and if no said player achieves a predetermined winning combination of said displayed indicia, comparing said indicia displayed to each said player and providing an award to at least one player having a pre-determined value of said displayed indicia. In accordance with yet another embodiment of the present invention, a method of playing overlapping games of bingo is disclosed. The method comprises the steps of: providing at least one player with a player terminal; providing two or more ball draws; commencing a first game of bingo with a first ball draw; said at least one player participating in said first game of bingo; allowing said first game of bingo to proceed for a specified period of time prior to closing; and commencing another game of bingo with another ball draw prior to said closing of said first game.

DETAILED DESCRIPTION OF THE PREFERRED EMBODIMENTS

Referring first to FIGS. 1-4, an embodiment of the bingo game of the present invention having the look and feel of video poker is shown. For ease of reference, this game will be referred to as "Bingo Poker" herein.

Figure 4:
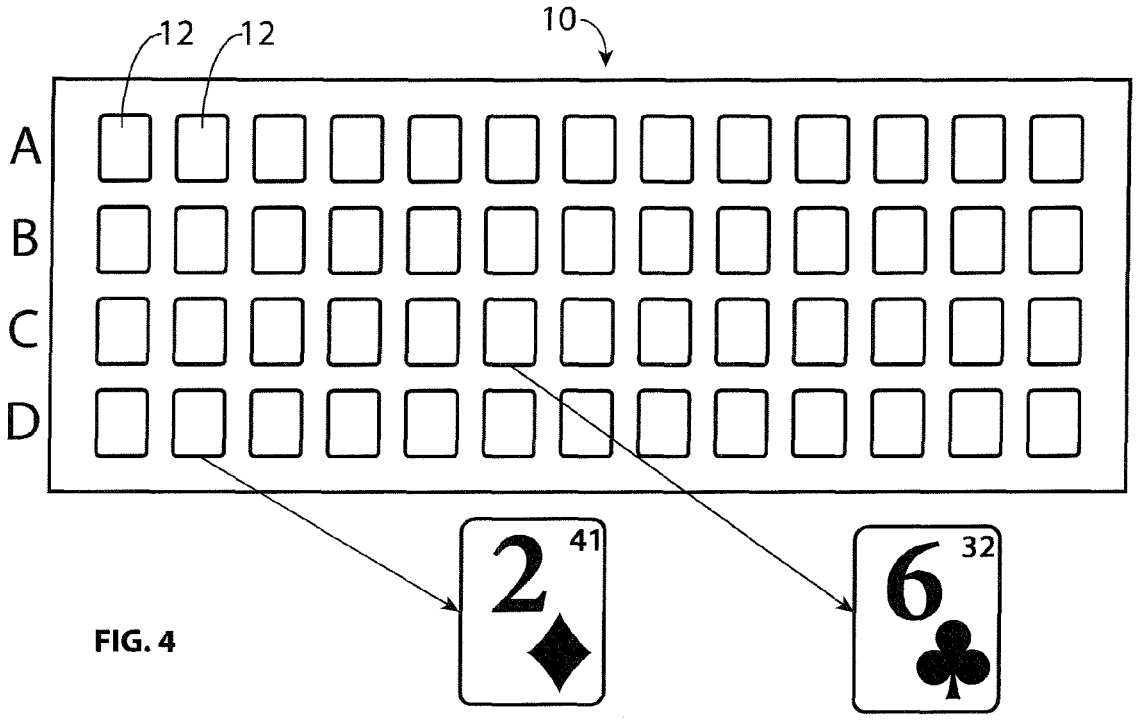
FIG. 4 shows a flashboard component of an embodiment of a bingo game of the present invention, with two flashboard squares shown in detail.

Referring first to FIG. 4, each player is provided with a flashboard/bingo card 10 (hereinafter "flashboard 10"). The flashboard 10 may optionally be displayed to the player on a video screen, or may simply be provided to the game terminal but not displayed. In order to provide a less cluttered appearance, and to enhance the poker-like look of the game, it will be preferred to not display the flashboard 10 on the gaming machine screen.

In its preferred configuration, the flashboard 10 contains a plurality of individual squares 12. Each square 12 is intended to correspond to a particular numbered ball used in the game, with the total number of squares corresponding to the total number of numbered balls used. As shown in FIG. 4, in this embodiment, there are 52 squares 12, corresponding to 52 balls. As will be discussed below, it will be possible to vary the number of squares 12 and balls, and indeed, it would be possible to provide a noncorresponding number of squares 12 and balls.

It should be noted further that if the flashboard 10 is to be displayed to the player, the configuration shown in FIG. 4—having four rows of thirteen squares each, with, reading from left to right, row A having squares 1-13, row B having squares 14-26, row C having squares 27-39, and row D having squares 40-52—is only one of many that would be possible. Thus, it would be possible to organize the squares 12 into any desired combination of rows and columns or other display arrangement.

Preferably, each individual square 12 has assigned thereto appropriate indicia corresponding to the specific game that is to be played. For Bingo Poker, the indicia will comprise suit and value indicia commonly displayed on playing cards. For example, as shown in FIG. 4, square 32 has been assigned as its suit and value indicia the six of clubs. Square 41 has been assigned as its suit and value indicia the two of diamonds. In a Bingo Poker game that utilizes 52 balls and thus at least 52 squares 12, each square 12 will have different suit and value indicia, so that each card in a 52 card deck is represented in a different square 12.

While, in this embodiment, the indicia used correspond to that displayed on playing cards, it should be understood that indicia from other card-type games could be used, and the game played according to rules for such card-type game.

The suit and value indicia may be randomly generated on each square 12 of each flashboard 10 before each game. Alternatively, different flashboards 10 may be created before play is begun by the players depressing an appropriate button/key or otherwise commanding the player machine to generate randomly different indicia locations on flashboard 10. However created, each flashboard 10 will have its unique (or nearly unique) placement of indicia, thus providing preferably different flashboards 10 for each player and different outcomes for each machine. For example, while square 32 on player one's flashboard might have a Club suit indicia and a Six value indicia, square 32 on player two's flashboard might have a Heart suit indicia and a Queen value indicia. Thus, the calling of ball/number 32 will provide player one with a Six of Clubs and player two with a Queen of Hearts.

Figure 1:
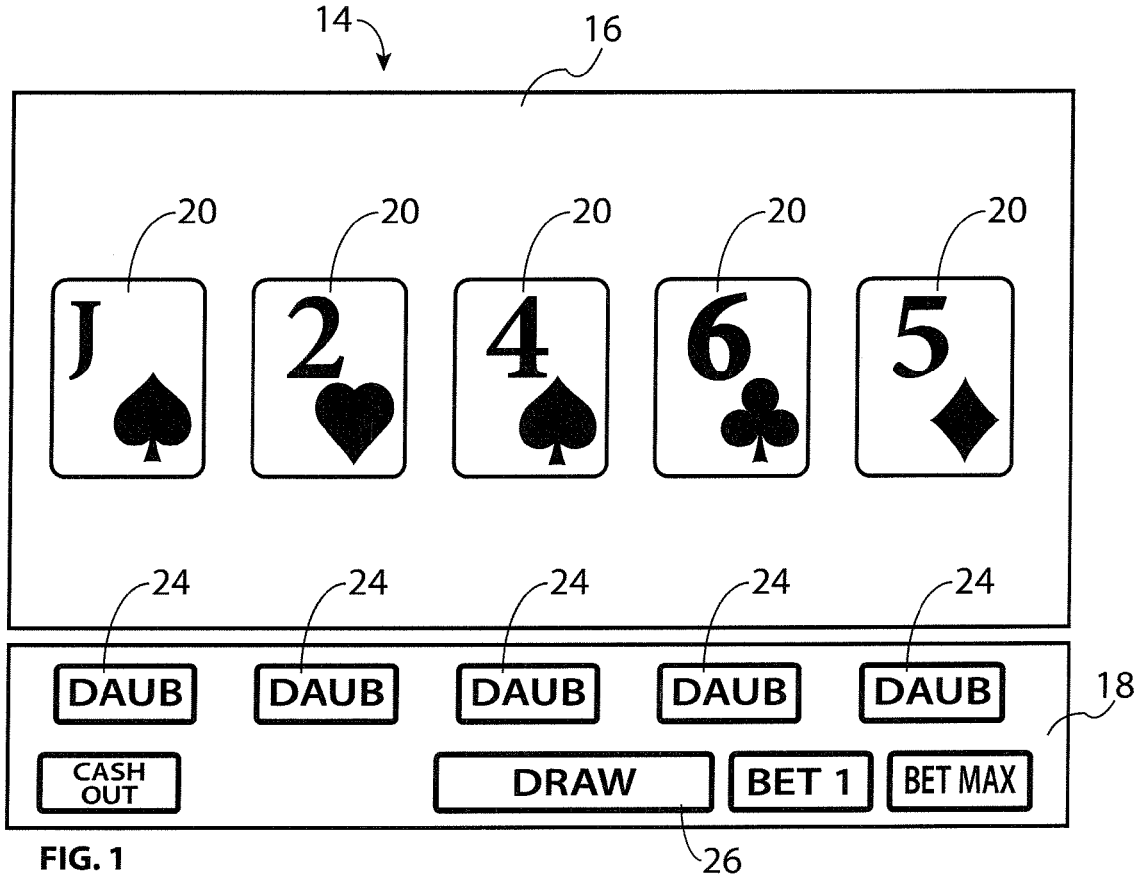
FIG. 1 provides an exemplar of a video terminal, including display screen, of one embodiment of a bingo game of the present invention.
Figure 2:
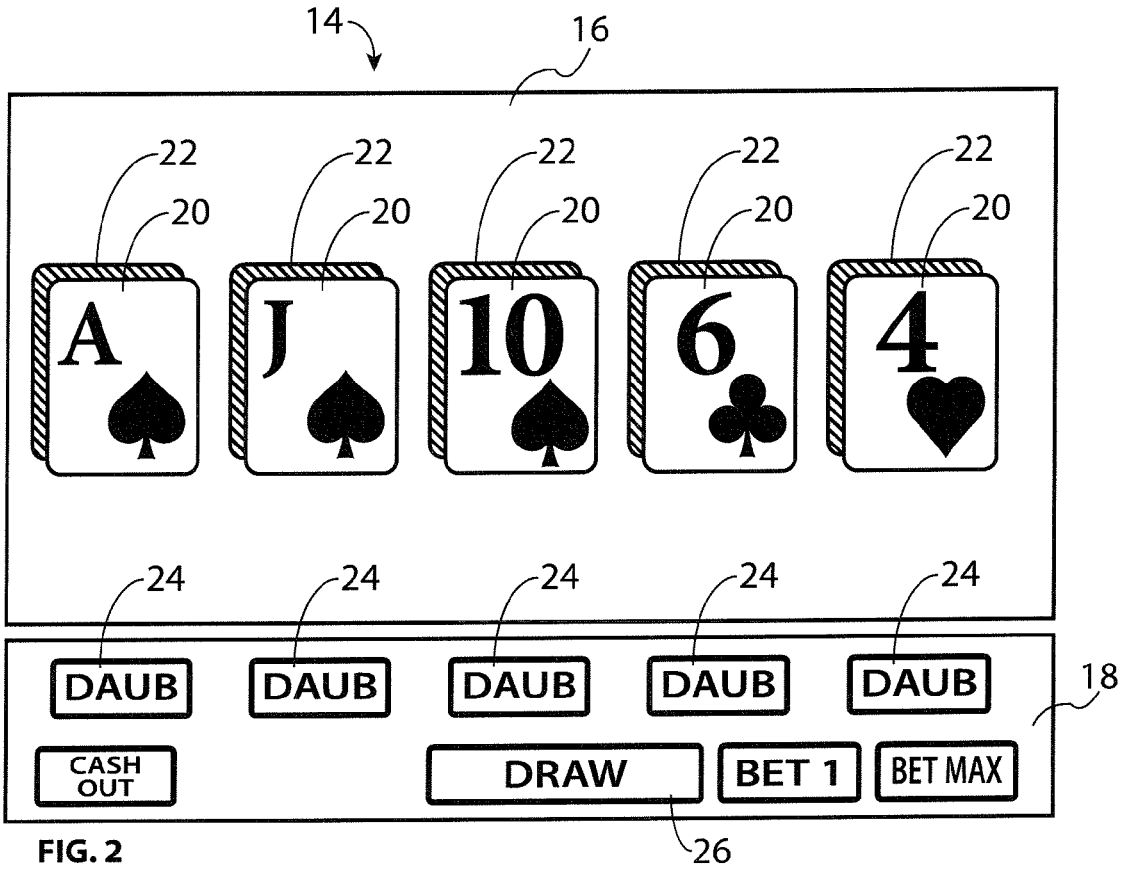
FIG. 2 provides an exemplar of a video terminal, including display screen, of another embodiment of a bingo game of the present invention.

As each ball is drawn and called, the result is electronically communicated to each player machine. (It should be understood that the reference to a ball draw and call is intended to include an electronic draw and an electronic communication of the results of the draw to player machine, and is not meant to be restricted to a manual ball draw or live call by a person.) Referring now to FIG. 1, an exemplar of a player machine 14 is shown. The player machine 14 preferably includes a display screen 16 and a play selection area 18. (It should be understood that the play selection area 18 could be positioned on the player machine 14 separate from the display screen 16 as shown in FIG. 1, or could be displayed on the display screen 16 using touch screen technology or the like.)

Still referring to FIG. 1, the results of the calling of five balls are displayed on the display screen 16, in the form of cards 20 having suit and value indicia corresponding to numbered squares 12 on the flashboard 10. As shown in FIG. 1, the preferred form for displaying the results of the call is in card form, giving the Bingo Poker game the look and feel of a video poker terminal. In the event that the flashboard 10 is also displayed on the display screen 16, it is preferred that upon the calling of each ball, the corresponding square 12 is lit or otherwise modified to indicate that the ball corresponding to that square has been called.

In the preferred embodiment of Poker Bingo, ten balls are called at the beginning of the game. As shown in FIG. 1, only the results for the first five balls will initially be displayed. With respect to the remaining five balls, they are either not initially depicted in any form to the player as shown in FIG. 1, or, referring now to FIGS. 2 and 3, may be represented by an image of a card back 22 or in some other form. (In the event that the flashboard 10 is displayed to the player on the display screen 16, the squares 12 and indicia associated with second group of five balls are not indicated on the flashboard 10 either.)

Each player then electronically daubs those of the first five balls that the player desires to keep by, one card 20 at a time, daubing each card 20 that the player wishes to hold or discard. Daubing is preferably accomplished by the player depressing the daub button 24 for each card to be held—which daub button 24 may be a depressible button or key located in the play selection area 18, a selectable area on a display screen 16 having touch screen capability, or some other vehicle for allowing a player to communicate card selection. (It would also be possible to provide that depression of the daub button 24 would have the effect of highlighting those cards 20 that are to be discarded .)

Once daubing is complete, the player depresses the draw button 26. (It should be noted that the names for the buttons as shown in the drawing figures and as used herein represent examples only, and may be changed as desired.) The undaubed cards 20 are then discarded and replaced with a corresponding number of cards 20 corresponding to balls from the second group of five. If the player daubs (holds) all five cards 20, then no replacement cards are used and the winning hand will be determined using only the original five balls drawn.

There are several possibilities with respect to the manner in which replacement cards 20 are selected from the group corresponding to the second group of five balls. In one embodiment, the machine randomly selects the replacement cards 20 from the second group. In another embodiment, replacement cards 20 are selected from the second group of five balls according to the order in which these balls were called—so that the sixth ball called will be the first replacement, and so on. In yet another embodiment, as depicted for example in FIG. 2, the replacement cards 20 selected will be those corresponding in order to the first five balls selected—so that, for example, the first ball selected will be represented by the first card 20 on the far left side, while the sixth ball selected will be represented by the card back 22 positioned behind the first card 20 on the far left side, and so on.

Figure 3:
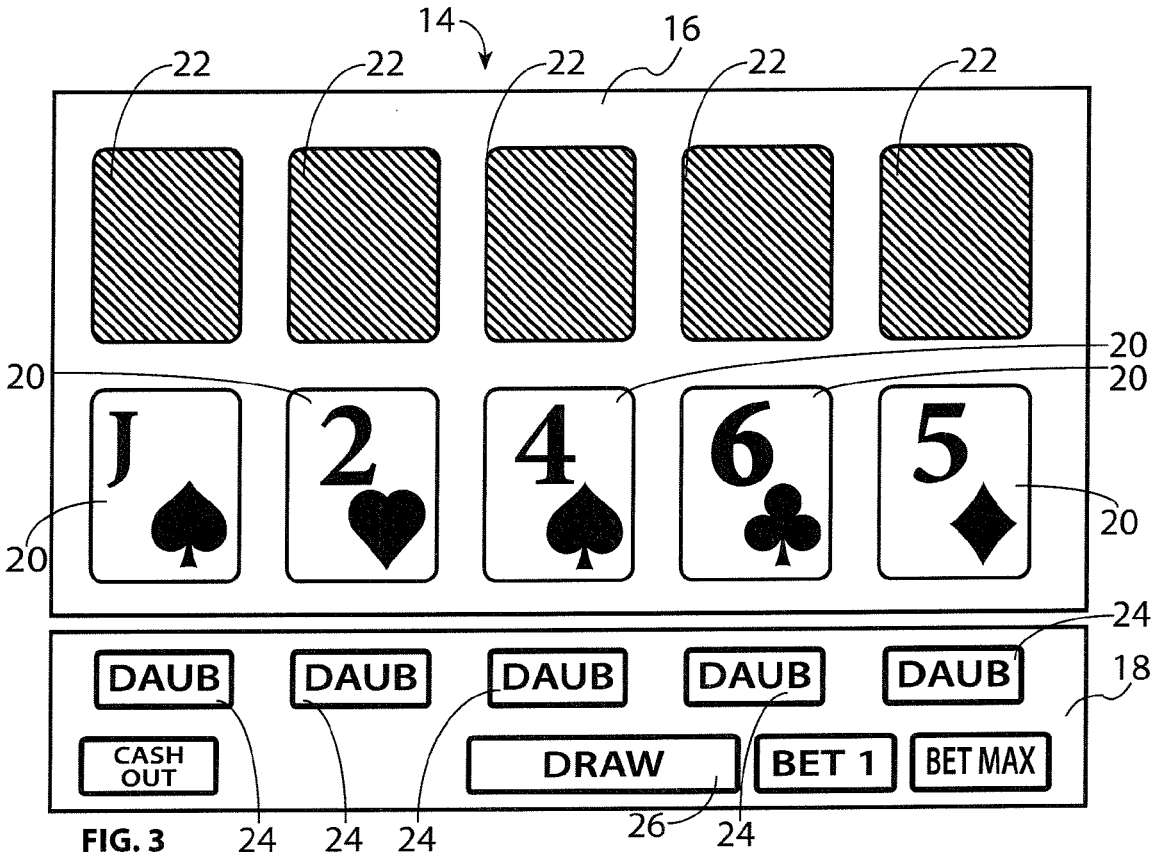
FIG. 3 provides an exemplar of a video terminal, including display screen, of yet another embodiment of a bingo game of the present invention.

In still another embodiment, as depicted for example in FIG. 3, the player can select which replacement cards 20 will be revealed from a row of card backs 22 shown on the display screen. Selection may be accomplished, if touch screen technology is employed, by the player touching the desired card backs 22. Alternatively, the player may depress the daub button 24 associated with the desired card back 22—which, in the configuration shown in FIG. 3, would be the daub button 24 positioned directly below the desired card back 22—revealing each replacement card 20.

When the final hand is displayed, the machine determines whether the hand is in the payoff schedule. For each player hand falling within the payoff schedule, payment is made. Another feature of the preferred embodiment of the bingo game and method of this invention addresses the common bingo requirement that there be at least one winner in every bingo game played. This can be accommodated in one of several ways. Preferably, if there are no "winners" in a particular game—i.e., no final hands within the payoff schedule—the hands of all players will be compared the player or players having the lowest value hand—calculated according to the game rules for the particular poker or other game played—will receive a payout. Similarly, the player with the highest value non-paying hand could be rewarded (example, four cards to a Royal Flush losing hand.). (This latter approach rewards a near-miss, sometimes referred to as a "near-miss" or "case" bingo.) It would also be possible, instead of rewarding the lowest or highest hand, to provide a mystery payout to one randomly selected player in each game. As used herein, the terms "near-miss" or "case" bingo—are meant to refer to any hand outside the pay table that entitles the player to an award. It should be noted further that a near-miss or case bingo hand can be rewarded even when another player achieves a hand within the pay table—or only when no player achieves a hand within the pay table.

To increase player excitement, it is possible to provide a progressive jackpot for the player(s) achieving a case bingo. For example, a portion of the pool from each game can be placed in a separate pool to reward a case bingo hand, regardless of the criteria by which the case bingo hand is selected. If a significant number of games is played without a case bingo hand receiving an award, the pool can grow significantly, increasing player excitement and perhaps leading some players to purposefully try for a case bingo hand because of the size of the progressive jackpot. It would also be possible to require players to make a separate wager to be able to qualify for the progressive jackpot.

It should be noted that the Bingo Poker game and method of the present invention may be adapted to play poker or other card games according to the rules for the particular game. For example, in one variation, only five balls would be drawn, and there would be no replacement balls. Based on the hand produced by the five called balls, the player receives any payout to which he or she is entitled. (Such a game might have the appearance of that shown in FIG. 1.) This variation is similar to 5card stud poker, in which a player is paid according to a pay table without any replacement cards being available.

In another variation, seven balls are called and, again, there are no replacement balls. Based on the best hand produced by any five of the seven called balls, the player receives any payout to which he or she is entitled. This variation is similar to 7card stud poker.

Examples of other poker games that could be played using this method would include triple play®, bonus poker, Caribbean stud poker®, holdem poker, and double down stud®. The present invention could also be utilized to play card games other than poker.

Still other variations are possible to the basic components of the bingo game as discussed above. For example, it would be possible to add a 53rd ball as well as a corresponding 53rd square on the flashboard 10, with the 53rd square representing a wild card or joker. If called, the wild card could be used by the player to represent any suit/value indicia combination that increases the payout to the player.

It would also be possible to provide fewer squares 12 than balls, with an individual square 12 having more than one set of value and suit indicia. If, for example, a particular square 12 had two sets of value and suit indicia, the calling of the ball corresponding to that square 12 would result in an extra card being dealt to the player. The player could either be permitted to keep the extra card or the option of selecting between the two cards corresponding to the square 12, increasing the player's winning prospects. Other variations are also possible.

Another embodiment of the present invention addresses the problem presented by a single ball draw. In this embodiment, overlapping ball draws—possibly though not necessarily from multiple locations—are provided, allowing the playing of overlapping games. For example, if a game takes two minutes to play, a new draw could commence every thirty seconds. Fast player one and slower player two each begin the same game at 1:00 p.m., which game is started by ball draw one. Fast player one, upon finishing the game at 1:00:45 p.m., can participate in a second game, started by a ball draw commencing at 1:01:00 p.m.—even before the first game has closed at 1:02 p.m. Meanwhile, player two can finish his game using all of the allotted time until 1:02 p.m., and participate in a new game commencing at 1:02:00 p.m. or 1:02:30 p.m., etc. Of course, the actual frequency and method of overlapping ball draws can be varied as desired.

One advantage of the multiple ball draw is that the duration of each bingo game can be increased over prior art games, since there is no need to maximize the amount of games that one single ball drawing source can generate. Thus, it can be seen that with multiple ball draws, the needs of slow and fast players can be accommodated. Slow players can play games with longer closing times, so that they can complete their play. On the other hand, fast players can follow one game immediately with another. It should be noted that the multiple ball draw disclosed herein could be incorporated into any bingo-style electronic game—including prior art games currently practiced using a single ball draw—and not only with bingo-style games otherwise described herein.

Bingo rules often require the disclosure to all players at the end of each game how many players were winners in each game and how much they won. This information can be provided in a small square preferably at the bottom of the screen. In one embodiment, the five previous game winners will be disclosed at the bottom of the screen—although more or less than this could be shown. This allows the slower player to take his or her time and to have his or her potential winnings posted before the game is closed.

In another embodiment of the present invention, the rules of bingo can be adopted to provide an electronic game having the look and feel of a video slot machine, and includes on the display a plurality of reels. This game is referred to herein as "Bingo Slots." As with Bingo Poker, in Bingo Slots, each player is provided with at least one flashboard, which flashboard may or may not be displayed on the player's display screen. The flashboard should comprise individual squares having therein at least one indicia—including for example cherries, plums, bells, bars, blanks and other indicia of the type often seen on slot machines—corresponding to the number of bingo balls to be drawn. For example, if there are 90 balls (numbered 1-90), the flashboard should have 90 "squares," numbered 1-90, having indicia therein. (As discussed above, it would be possible to provide a noncorresponding number of flashboard squares and balls.)

Preferably, three balls will be called in a game (i.e., one ball for each reel)—although games with less or more balls may also be played. When the balls are called, the values are communicated to each player machine and the corresponding values on each player flashboard are displayed in any desired format—such as squares or rectangles having images of the indicia therein or thereon. Preferably, the display will have the look and feel of prior art slot machine reels.

Although each player has the same indicia values on his or her flashboard (e.g., 20 cherries, 20 bars, 10 blanks, 10 plums, 30 bells)—each player should have these indicia arranged on the flashboard in a unique or nearly unique manner, so that outcomes among players will be unique or nearly unique. For example, squares 15, 25, and 35 on player one's flashboard might all be cherries, while these squares on player two's flashboard are a cherry, plum, and bar, respectively. There can of course be instances wherein a single machine has multiple type slot games to choose from and individual games can have varying degrees of difficulty. An example of these slot games are "Double Diamond®", "Red, White & Blue®", "Triple Diamond®.", "Wheel of Fortune®", "Elvis®", "Betty Boop®" "Slotto®','"Pink Panther®", "Reel 'Em In®", "Monopoly®", "Jackpot Party®.", "Addams Family®", 'I Dream of Jeannie®" and "Battleship®," The payout will be a function of the difficult of achieving a desired combination, based on the frequency with which a particular value appears on the flashboard.

While it would be possible to provide a single flashboard from which three indicia will be selected as described herein, it would be preferred to provide multiple flashboards per player machine, and preferably one flashboard for each reel in a Bingo Slot game. Thus, if there are three reels, three flashboards are preferably provided. In this manner, the odds of achieving a particular winning combination can be increased exponentially, creating the possibility of relatively large payouts and thus increasing player excitement. Similarly, the number of balls/flashboard squares can be varied as desired to achieve desired game probabilities.

As shown in the following table, the use of multiple flashboards and the variation in the number of balls can substantially alter slot odds:

| Number of Reels | Number of Balls | Slot Odds—One bar per reel |
|---|---|---|
| 1 | 75 | 75 to one |
| 1 | 90 | 90 to one |
| 1 | 105 | 105 to one |
| 2 | 75 | 5,625 to one |
| 2 | 90 | 8,100 to one |
| 2 | 105 | 11,025 to one |
| 3 | 75 | 421,875 to one |
| 3 | 90 | 729,000 to one |
| 3 | 105 | 1,157,625 to one |
| 4 | 75 | 31,640,625 to one |
| 4 | 90 | 65,610,000 to one |
| 4 | 105 | 121,550,625 to one |

Of course, the numbers 75, 90 and 105 are meant to be exemplary only, and the actual number of balls used could be varied as desired.

Figure 5:
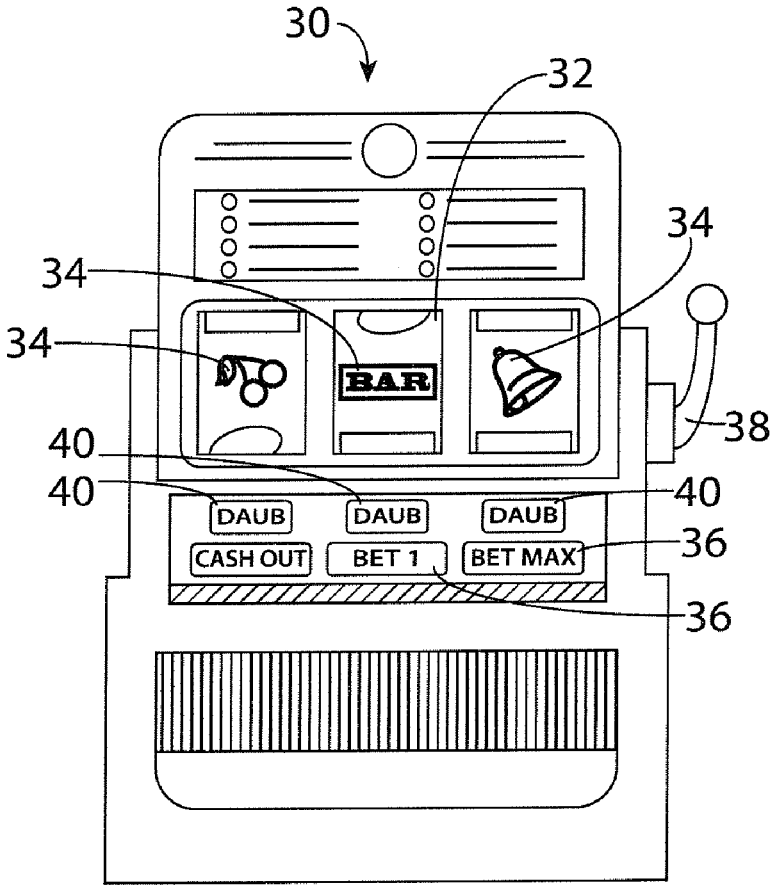
FIG. 5 provides an exemplar of a video terminal, including display screen, of still another embodiment of a bingo game of the present invention.

Referring now to FIG. 5, an exemplar of a video terminal 30 embodying the Bingo Slots variant of the present invention is shown. The video terminal 30 includes a display screen 32, on which is displayed the indicia 34 from the flashboard squares corresponding to the called balls. To use the video terminal 30, a player will place his or her bet using one of the betting keys 36. The player then commences play and accesses the results of the ball draw by pulling the handle 38. The results of the ball draw are then displayed on the display screen 32. To complete play, and consistent with the rules of bingo, the player daubs the indicia 34 appearing on the display screen 32 by depressing the daub keys 40—or by daubing in some other designated manner.

Of course, the features of the video terminal 30 may be altered in any desired fashion. For example, the handle 38 may be replaced with a button, touch screen icon, or other means for commencing play. One daub key 40 could be used in place of individual daub keys 40 for each indicia 34 displayed. It would also be possible to display more than one row of indicia 34 for double, triple, nine-line, etc. play. Still further, it would be possible to substitute a machine having mechanical reels for the video terminal 30 and still be within the scope of the present invention.

While the invention has been particularly shown and described with reference to preferred embodiments thereof, it will be understood by those skilled in the art that the foregoing and other changes in form and details may be made therein without departing from the spirit and scope of the invention.

I claim:

1. A video gaming system comprising a processor for executing program instructions and a memory coupled to the processor for storing the program instructions, the programming instructions comprising:

providing each player with a flashboard having a plurality of numbered spaces;

wherein each one of said plurality of numbered spaces has only a single indicia associated therewith;

providing a plurality of bingo balls for common use for all players with each bingo ball having an individual number corresponding to a single numbered space and its single indicia on said flashboard for each player; the plurality of numbered spaces on each player's flashboard having a total number that corresponds to a total of all of the bingo balls;

initiating the bingo game;

randomly selecting a first group of bingo balls for common use for all players;

displaying to each player said single indicia associated with each said numbered space corresponding to each selected bingo ball; and providing an award to said at least one player if solely from randomly selected bingo balls at least one player achieves a predetermined winning combination of bingo balls each having a number corresponding to a single numbered space with its single indicia on said flashboard.

2. The video gaming system of claim 1, wherein said indicia comprises each of suit and value indicia.

3. The video gaming system of claim 1, wherein said indicia comprises indicia of the type commonly displayed on slot-type machines.

4. The video gaming system of claim 1, wherein the program instructions further comprises randomly selecting a second group of said bingo balls and wherein said second group of said bingo balls comprises five said bingo balls.

5. The video gaming system of claim 4, wherein the program instructions further comprises displaying to each said at least one player a representation of said indicia associated with each said numbered space corresponding to each of said second group of five bingo balls wherein said representation conceals from view said indicia associated with each said numbered space corresponding to each of said second group of five bingo balls.

6. The video gaming system of claim 5, wherein said representation comprises an image of a back of a playing card.

7. The video gaming system of claim 4, wherein the program instructions further comprises a first bingo game commences with said randomly selecting said first group of said bingo balls, wherein a second bingo game commences with said randomly selecting said second group of bingo balls, and further comprising the steps of allowing said first game of bingo to proceed for a specified period of time prior to closing, and wherein said second bingo game commences prior to said closing of said first bingo game.

* * * * *